US006113297A

United States Patent [19]

Kovacik

[11] Patent Number: 6,113,297

[45] Date of Patent: Sep. 5, 2000

[54] RING BINDER STORAGE DEVICE

[76] Inventor: Peter Thomas Kovacik, 5392 Santa Rita Ave., Garden Grove, Calif. 92845

[21] Appl. No.: 08/912,532

[22] Filed: Aug. 18, 1997

[51] Int. Cl.[7] ..... B42D 3/12; B42F 3/00

[52] U.S. Cl. ..... 402/4; 281/28; 281/37; 402/79

[58] Field of Search ..... 281/37, 28; 402/79

[56] References Cited

U.S. PATENT DOCUMENTS 4,244,660 1/1981 Aronson ..... 402/79
5,498,089 3/1996 Motyka ..... 402/79

*Primary Examiner*—Willmon Fridie, Jr.
*Assistant Examiner*—Mark T. Henderson

[57] ABSTRACT

A ring binder storage device that includes a generally rectangular supporting member. The support member is sized for positioning within a ring binder. The support member has a top surface and a bottom surface. The support member has a pair of elongated peripheral side edges with a pair of short peripheral edges therebetween. A plurality of openings being cut through the support member. Also, a housing member is interconnected to the top surface of the support member and adjacent one of the pair of elongated side edges. The housing member is capable of having a writing utensil positioned within. The ring binder has a plurality of rings may be in an open position for passing through at least two of the openings of the support member for holding thereon.

5 Claims, 5 Drawing Sheets

FIG. 8
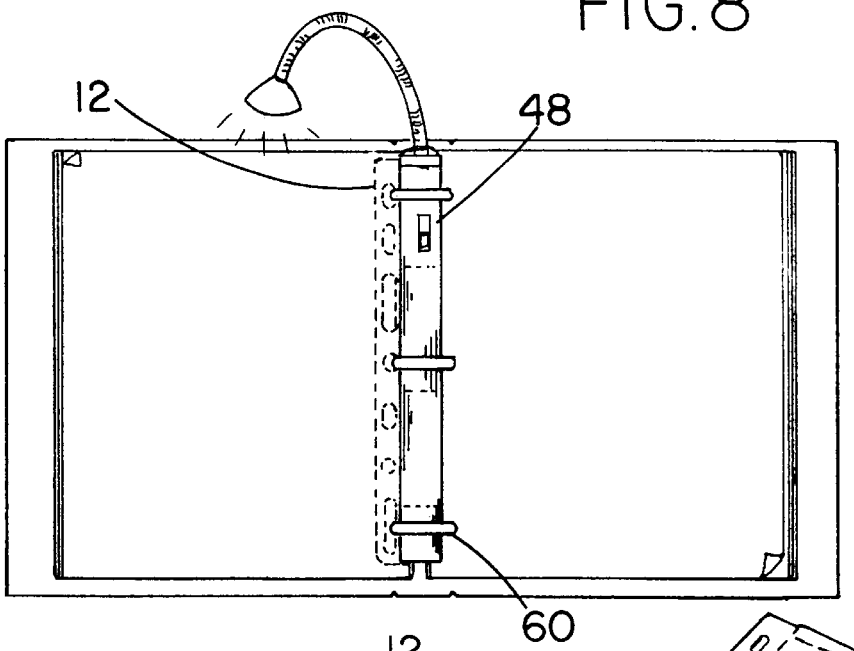
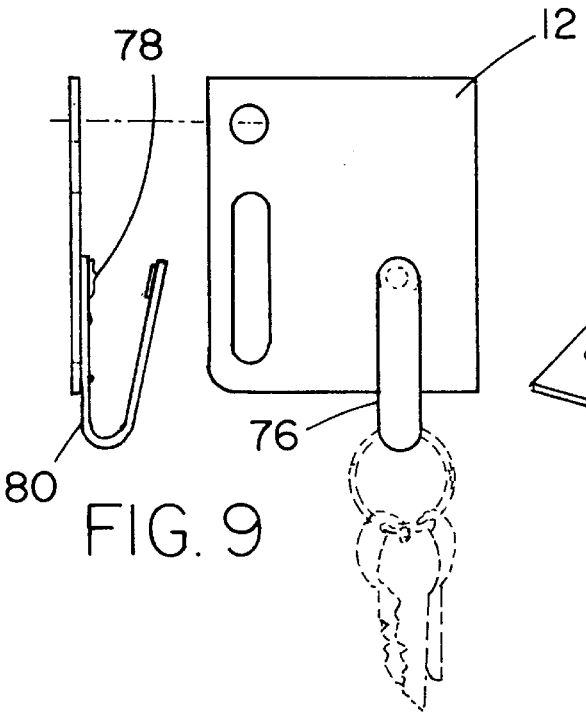
FIG. 9
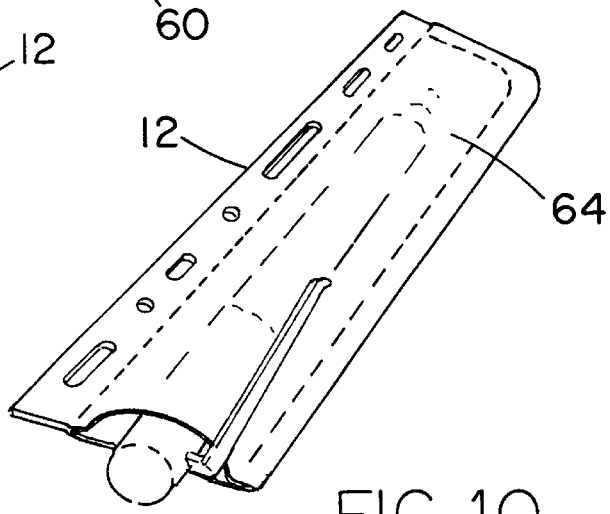
FIG. 10

RING BINDER STORAGE DEVICE

BACKGROUND OF THE INVENTION

1. Field of the Invention

The present invention relates to a ring binder storage device and more particularly pertains to providing a support member, with an interconnected housing member that engages the rings of a ring binder and further having the housing member positioned between the rings.

2. Description of the Prior Art

The use of a binder pocket is known in the prior art. More specifically, binder pocket heretofore devised and utilized for the purpose of holding articles are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,350,249 to Peters discloses a binder pocket. U.S. Pat. No. 4,852,740 to Sellar and Lappiea discloses a holder for flat objects such as computer disks. U.S. Pat. No. 4,820,071 to Steinfield and Woodruff discloses an accessory holder for a ring binder. U.S. Pat. No. 4,614,450 Neiman discloses a portable index card holder for notebooks. U.S. Pat. No. 4,508,366 to Brindle discloses holders for computer disks and the like. Lastly, U.S. Pat. Des. No. 329,943 to Laszlo discloses a case for holding computer, video or phonographic discs or the like.

In this respect, the ring binder storage device according to the present invention substantially departs from the conventional concepts and designs of the prior art, and in so doing provides an apparatus primarily developed for the purpose of providing a support member, with an interconnected housing member that engages the rings of a ring binder and further having the housing member positioned between the rings.

Therefore, it can be appreciated that there exists a continuing need for a new and improved Ring binder storage device which can be used for providing a support member, with an interconnected housing member that engages the rings of a ring binder and further having the housing member positioned between the rings. In this regard, the present invention substantially fulfills this need.

SUMMARY OF THE INVENTION

In view of the foregoing disadvantages inherent in the known types of binder pocket now present in the prior art, the present invention provides an improved ring binder storage device. As such, the general purpose of the present invention, which will be described subsequently in greater detail, is to provide a new and improved ring binder storage device which has all the advantages of the prior art and none of the disadvantages.

To attain this, the present invention essentially comprises a generally rectangular supporting member is provided. The supporting member is sized for positioning within a ringed binder. The support member has a top surface and a bottom surface. The support member has a pair of elongated peripheral side edges with a pair of short peripheral edges therebetween. The elongated peripheral side edges define a first elongated side edge and a second elongated side edge. The peripheral short edges define a first short edge and a second short edge. A plurality of openings are cut through the support member and spaced from the first elongated side edge. The plurality of openings are proportionately spaced along a common axis that extends a length of the support member. A housing member is interconnected to the top surface of the support member and adjacent the second elongated side edge. The housing member has a first side wall and a second side wall. Each side wall projects upwardly from the top surface of the support member and extends the length of the support member. Each side wall has an upper overhang. The over hang of each side wall projects inwardly. Each side wall has a slot that is sized for receiving a divider. The divider is capable of dividing the housing member into a large compartment and a small compartment. The large compartment is sized for receiving writing utensils and the small compartment is sized for receiving miscellaneous items. Included is a lid that is sized for positioning over the housing member. The lid encloses the writing utensils and miscellaneous items within the housing member. The lid has a pair of elongated channels. One of each channel engages one of the over hangs of the elongated side walls of the housing member and allows the lid to slid on and off of the housing member. Lastly, the ringed binder has a plurality of rings that open and close. The rings, when in an open position, are capable of passing through at least two of the openings of the support member. The rings, when closed allow the support member to be held thereon and the housing member to be positioned between the rings.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ring binder storage device which has all the advantages of the prior art binder pockets and none of the disadvantages.

It is another object of the present invention to provide a new and improved ring binder storage device which may be easily and efficiently manufactured and marketed.

It is a further object of the present invention to provide a new and improved ring binder storage device which is of a durable and reliable construction.

An even further object of the present invention is to provide a new and improved ring binder storage device which is susceptible of a low cost of manufacture with regard to both materials and labor, and which accordingly is then susceptible of low prices of sale to the consuming public, thereby making such ring binder storage device economically available to the buying public.

Still yet another object of the present invention is to provide a new and improved ring binder storage device which provides in the apparatuses and methods of the prior art some of the advantages thereof, while simultaneously overcoming some of the disadvantages normally associated therewith.

Still another object of the present invention is to providing a support member, with an interconnected housing member that engages the rings of a ring binder and further having the housing member positioned between the rings.

Lastly, it is an object of the present invention to provide a new and improved ringed binder storage device that has a generally rectangular supporting member. The support member is sized for positioning within a ring binder. The support member has a top surface and a bottom surface. The support member has a pair of elongated peripheral side edges with a pair of short peripheral edges therebetween. A plurality of openings being cut through the support member. Also, a housing member is interconnected to the top surface of the support member and adjacent one of the pair of elongated side edges. The housing member is capable of having a writing utensil positioned within. The ring binder has a plurality of rings may be in an open position for passing through at least two of the openings of the support member for holding thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a top plan view of the second embodiment of the housing member with a goose neck light attachment.

FIG. 9 is a cut-away view of the support member and key holder housing member.

FIG. 10 is an isometric view the first embodiment housing member showing the semi-cylindrical housing member as elongated.

Similar reference characters refer to similar parts throughout the several views of the drawings.

DESCRIPTION OF THE PREFERRED EMBODIMENT

Figure 1:
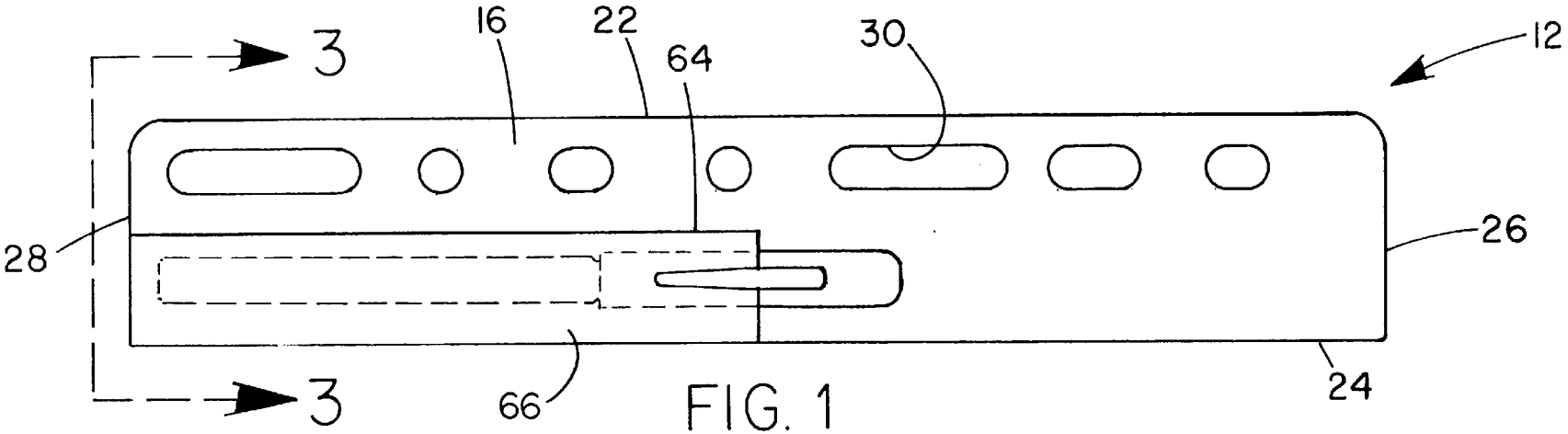
FIG. 1 is a perspective illustration of a ring binder storage device constructed in accordance with the principles of the present invention and having a first embodiment housing member.

With reference now to the drawings, and in particular to FIG. 1 thereof, a new and improved ring binder storage device embodying the principles and concepts of the present invention and generally designated by the reference numeral 10 will be described.

The present invention, the new and improved Ring binder storage device, is comprised of a plurality of components. Such components in their broadest context include a support member and a housing member. Such components are individually configured and correlated with respect to each other so as to attain the desired objective.

More specifically, the present invention includes two preferred embodiments for the housing member with each having a generally rectangular supporting member 12. The supporting member is sized for positioning within a ringed binder 14. The support member has a top surface 16 and a bottom surface 18. The support member is made of a flexible material, preferably a durable plastic.

Figure 2:
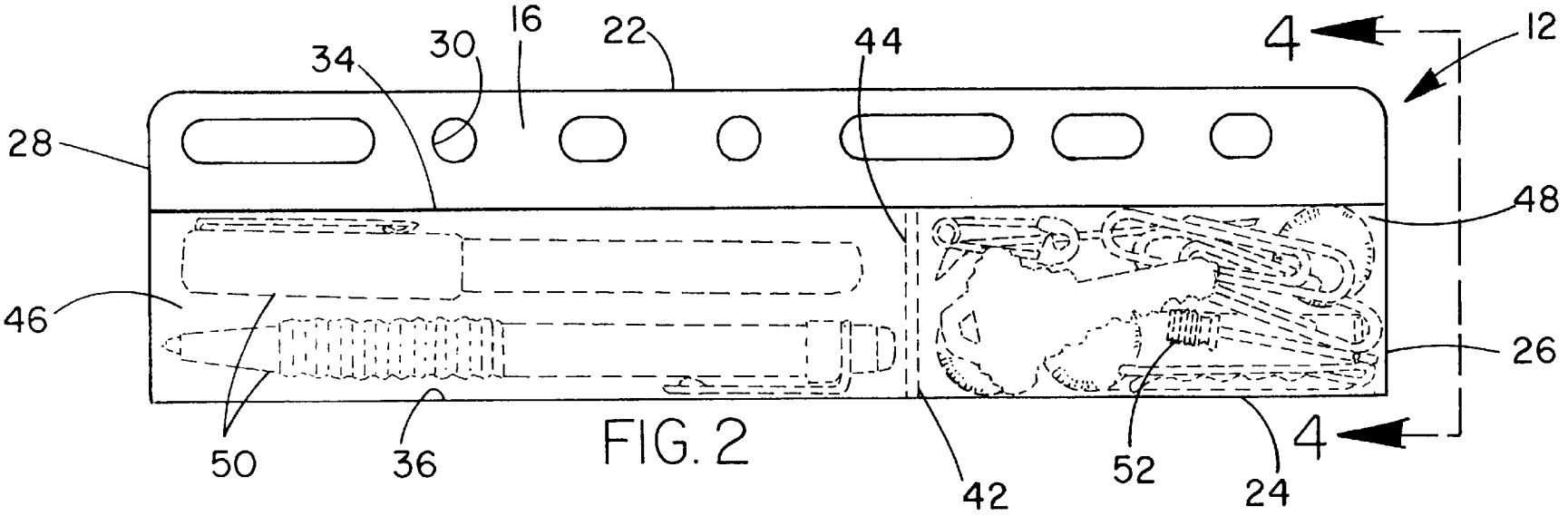
FIG. 2 is a perspective illustration of the present invention with a second embodiment housing member.
Figure 3:
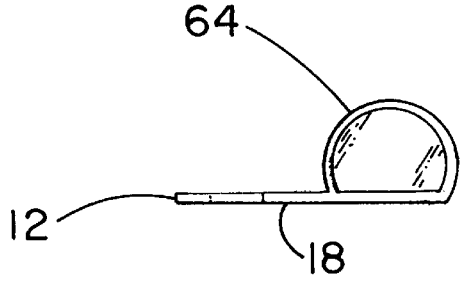
FIG. 3 is frontal view of the first embodiment of the housing member of the present invention.
Figure 11:
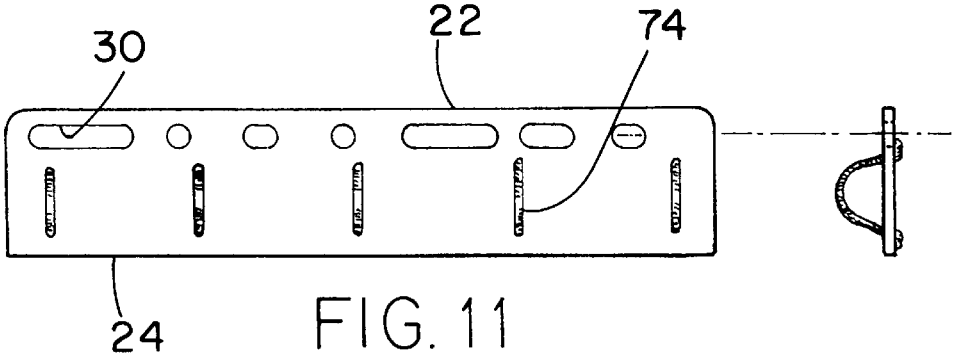
FIG. 11 is a top plan view of the support member showing the housing member as a plurality of straps.

As illustrated in FIGS. 1, 2 and 11, the support member has a pair of elongated peripheral side edges with a pair of short peripheral edges therebetween. The elongated peripheral side edges define a first elongated side edge 22 and a second elongated side edge 24. The peripheral short edges define a first short edge 26 and a second short edge 28.

A plurality of openings 30 are cut through the support member and spaced from the first elongated side edge. The plurality of openings are proportionately spaced along a common axis that extends a length of the support member. The plurality of openings are shaped and sized to fit a variety of rings of a ringed binder. A pair of the opening are oval, several are slightly oval and a pair of circular.

Figure 4:
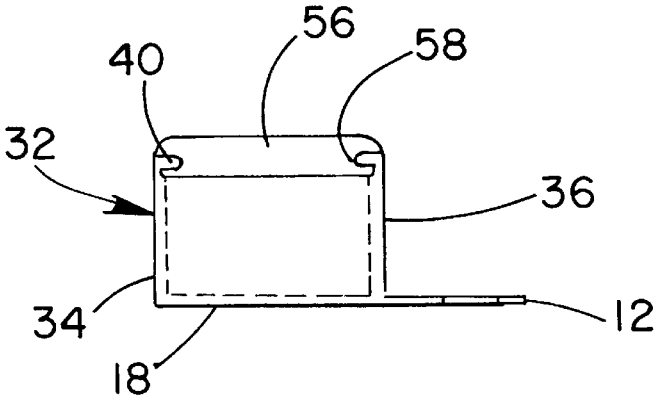
FIG. 4 is a frontal view of the second embodiment of the housing member of the present invention.
Figure 5:
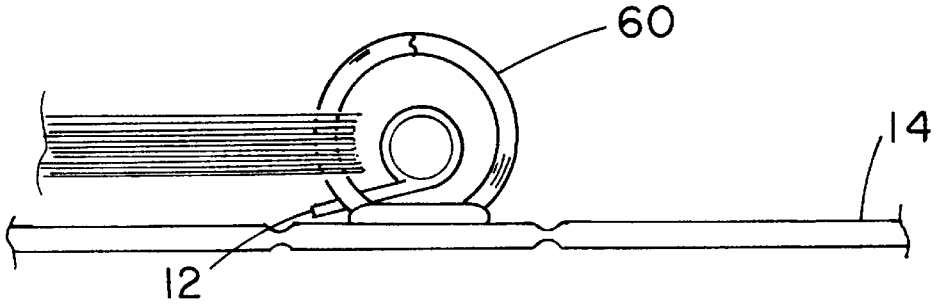
FIG. 5 is a cut-away view of the of the present invention of FIG. 1 in an operable orientation.
Figure 6:
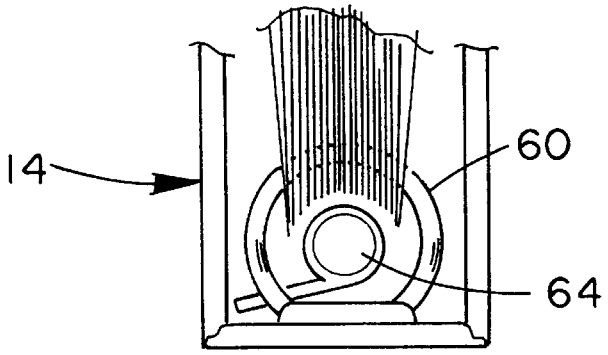
FIG. 6 is a cut-away view of the present invention of FIG. 1 in an operable orientation.

In the second embodiment a housing member is interconnected to the top surface 16 of the support member. The housing member is adjacent the second elongated side edge 24. The housing member 32 is generally rectangular and has a first side wall 34 and a second side wall 36. FIG. 4 shows that each side wall projects upwardly from the top surface of the support member. FIG. 4 shows that each side wall of the rectangular housing member 32 extends the length of the support member 12.

Additionally, each side wall has an upper overhang 40. The overhang of each side wall projects inwardly so as to allow the overhang of the first side wall to face the over hang of the second side wall. Each side wall has a slot 42 that is sized for receiving a divider 44. The divider is capable of dividing the rectangular housing member into a large compartment 46 and a small compartment 48, as depicted in FIG. 2. The large compartment is sized for receiving writing utensils 50 and the small compartment is sized for receiving miscellaneous items 52. In the second embodiment there could be a plurality of dividers that result in a plurality of sections or compartments. The dividers could be movable within the housing member without the need for slotted walls.

Included is a lid 56 that is sized for positioning over the rectangular housing member 32. The lid encloses the writing utensils and miscellaneous items within the housing member, as depicted in FIG. 2. The lid has a pair of elongated channels 58. One of each channel engages one of the over hangs of the elongated side walls of the rectangular housing member and allows the lid to slid on and off of the rectangular housing member in order to access the stored items.

The ringed binder 14 has a plurality of rings 60 that open and close. The rings, when in an open position, are capable of passing through at least two of the openings 30 of the support member 12. The rings, when closed allow the support member to be held thereon and the rectangular housing member to be positioned between the rings.

The first embodiment of the housing member of the present invention has an identical support member 12. This housing member 64 of the present invention is semi-cylindrical and interconnected to the top surface 16. The semi-cylindrical housing member 64 is opened at one end 66. The open end is spaced one of the pair of short peripheral edges 26 of the support member as shown in FIG. 1. The semi-cylindrical housing member 64 is closed at another end that is adjacent the other of the pair of short peripheral edges 28 of the support member 12. The semi-cylindrical housing member will carry a writing utensil.

Also, the first embodiment of the housing member, as shown in FIG. 10, can be lengthened to extend the entire length of the support member. When the semi-cylindrical housing member is extended a larger writing utensil will fit.

Figure 7:
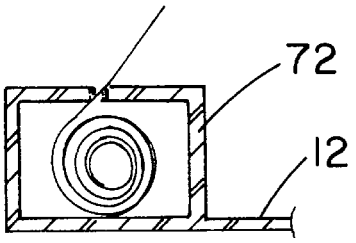
FIG. 7 is a cross-sectional view of the second embodiment of the housing member with a modification so as to support a roll of stamps.

As illustrated in FIG. 8, the smaller compartment 48 of the rectangular housing member will accommodate a goose neck lighting system 70. The light attachment is flexible and may be retractable. Also, the light embodiment may be mounted onto a rigid pol that attaches to the smaller compartment. The lighting system will light the pages of the ringed binder. The larger compartment is still able to have miscellaneous items contained within. Also, the second housing member may have a plurality of slots that will allow it to be divided into a plurality of smaller and larger compartments. One such compartment 72 is shown in FIG. 7. This compartment is structured to support a roll of stamps.

The housing member may have a third embodiment in the form of a plurality of flexible straps 74. As shown in FIG. 11, the flexible straps are proportionately spaced along a length of the support member 12. Each of the flexible straps is perpendicular the to the openings 30 of the support member. Each of the plurality of straps is coupled to the support member for carrying the miscellaneous items.

Lastly, the support member may be structured to have a key ring holder 76 mounted thereon. In FIG. 9, the key ring holder has a snap type fastener 78 for opening and closing of the key ring holder's loop 80.

Figure 12:
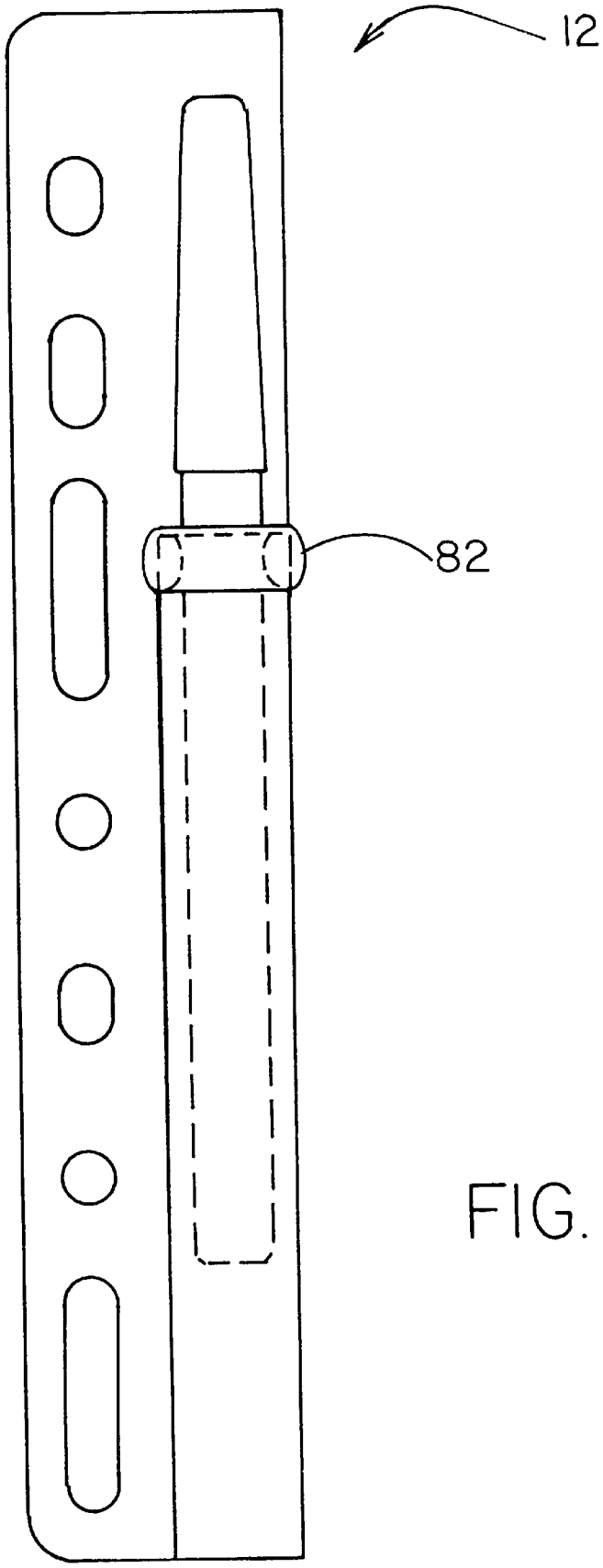
FIG. 12 is a perspective view of the ring binder storage device showing the first embodiment housing member having a cuff along the open end.

Furthermore, as shown in FIG. 12, the first embodiment housing member has a cuff 82 attached to the open end. The cuff is sized to allow only the smaller end of a writing utensil to be positioned within the first embodiment housing member. The cuff is incorporated to facilitate retention of the clipless writing utensil.

The present invention ringed binder storage device is specially designed for multi-ringed binders and/or planners. The present invention will turn the space between the rings of the binder into useful storage space. The present invention has a support member and a housing member. The housing member can support pens, pencils, stamps, coins, paper clips, erasers etc. The present invention is made of a molded plastic. The dimensions of the present invention will vary in accordance with the diameter of the various ringed binders.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ring binder storage device for allowing use of the spacing between the binder rings comprising in combination:

a generally rectangular supporting member being sized for positioning within a ringed binder, the support member having a top surface and a bottom surface, the support member having a pair of elongated peripheral side edges with a pair of short peripheral edges therebetween, the elongated peripheral side edges defining a first elongated side edge and a second elongated side edge, the peripheral short edges defining a first short edge and a second short edge, a plurality of openings being cut through the support member and spaced from the first elongated side edge, the plurality of openings being proportionately spaced along a common axis extending a length of the support member;

a housing member being interconnected to the top surface of the support member and adjacent the second elongated side edge, the housing member having a first side wall and a second side wall, each side wall projecting upwardly from the top surface of the support member and extending the length of the support member, each side wall having an upper overhang with the over hang of each side wall projecting inwardly, each side wall having a slot being sized for receiving a divider, the divider being capable of dividing the housing member into a large compartment and a small compartment, the large compartment being sized for receiving writing utensils and the small compartment being sized for receiving miscellaneous items;

a lid being sized for positioning over the housing member for enclosing the writing utensils and miscellaneous items therein, the lid having a pair of elongated channels, one of each channel engaging one of the over hangs of the elongated side walls of the housing member for allowing the lid to slid on and off of the housing member; and the ringed binder having a plurality of rings capable of opening and closing, the rings when in an open position being capable of passing through at least two of the openings of the support member, the rings being closed for allowing the support member to be held thereon and the housing member to be positioned between the rings.

2. A ring binder storage device comprising:

a generally rectangular supporting member being sized for positioning within a ringed binder, the support member having a top surface and a bottom surface, the support member having a pair of elongated peripheral side edges with a first length with a pair of short peripheral edges with a second length therebetween, a plurality of openings being cut through the support member;

a housing member being interconnected to the top surface of the support member and adjacent one of the pair of elongated side edges, the housing member formed as a pocket being capable of having a writing utensil positioned within; and the ringed binder having a height and a width with the height being essentially that of the first length, the housing member being generally rectangular and having a first side wall and a second side wall, each side wall projecting upwardly from the top surface of the support member, the support member having a length with the side walls extending for the length of the support member, and each side wall having an upper overhead with an over hang of each side wall projecting inwardly, and having a plurality of rings capable of being in an open position for passing through at least two of the openings of the support member for holding thereon.

3. The ring binder storage device as set forth in claim 2, wherein each side wall of the housing member having a slot being sized for receiving a divider, and the divider being capable of dividing the housing member into two compartments.

4. The ring binder storage device as set forth in claim 3, wherein one of the two compartment being capable of supporting a goose neck light system.

5. The ring binder storage device as set forth in claim 2, wherein a lid being sized for positioning over the housing member for enclosing the housing member, and the lid having a pair of elongated channels for engaging one of the overhangs of each of the elongated side walls of the housing member for allowing the lid to slid on and off of the housing member.

* * * * *